United States Patent [19]

Steadman

[11] 3,974,601

[45] Aug. 17, 1976

[54] MULTI-BLOCK SUPPORT CONSTRUCTION

[76] Inventor: Ernest H. Steadman, Rte. 2, Box 183, Ponchatoula, La. 70454

[22] Filed: Apr. 4, 1975

[21] Appl. No.: 565,122

[52] U.S. Cl. ..... 52/86; 52/227

[51] Int. Cl.[2] ..... E04B 1/32; E04C 3/10

[58] Field of Search ..... 52/86, 87, 89, 227, 52/224

[56] References Cited

UNITED STATES PATENTS

| | | | |
|---|---|---|---|
| 2,342,916 | 2/1944 | Blaski | 52/86 |
| 2,877,506 | 3/1959 | Almoslino | 52/227 |
| 3,568,385 | 3/1971 | Cruset et al. | 52/89 |

FOREIGN PATENTS OR APPLICATIONS

| | | | |
|---|---|---|---|
| 533,147 | 2/1922 | France | 52/86 |

*Primary Examiner*—J. Karl Bell
*Attorney, Agent, or Firm*—Pugh & Keaty

[57] ABSTRACT

An improved multi-block support construction system and method for constructing, for example, arches and straight load support shapes utilizing uniquely designed construction components to be assembled in a simple and quick manner to provide the overall support structure. The system includes rods for binding the basic building blocks together, as well as straight blocks and tapered blocks which form the components of straight and curved sections, respectively, of the support system. The preferred embodiment includes at least three blocks with a series of internal, angled tensioned rods joining them together.

13 Claims, 8 Drawing Figures

MULTI-BLOCK SUPPORT CONSTRUCTION

BACKGROUND OF THE INVENTION

1. Field of the Invention

The present invention relates to a support construction system and method for constructing arches and straight load support structures using a series of shaped block elements of for example two types to hold truss members together in straight or shaped arch construction. The present invention has been found to be particularly useful in arch construction, and hence, will be discussed with particular reference thereto. However, the present invention is applicable to many other types of construction systems as well, not only arch systems, and the term "arches" is used herein to include shapes of all sorts including straight sections.

2. Description of the Prior Art

Normal construction of supporting members including arches are performed by the use of prestressed concrete or other construction material shaped on a custom basis for the form of arch desired. In order to expedite construction and lower the cost of construction of support structures, it is desirable to use modular construction techniques with standard shaped components to form a support structure.

Several types of supporting structure systems and methods have been known and used before, and typical examples thereof in the support construction art are shown in U.S. Pat. No. 1,800,988, issued Apr. 14, 1931, to C. L. Ewing; U.S. Pat. No. 2,727,282, issued Dec. 20, 1955, to E. Cruciani; U.S. Pat. No. 2,614,512, issued Oct. 21, 1952, to R. C. Gross; U.S. Pat. No. 319,881, issued June 9, 1855, to W. P. Buckley; U.S. Pat. No. 3,144,103, issued Aug. 11, 1964, to T. H. Krueger, Jr.; U.S. Pat. No. 2,376,906, issued May 29, 1945, to L. Davidson; U.S. Pat. No. 3,494,082, issued February 10, 1970, to W. C. Adams, et al; U.S. Pat. No. 2,831,441, issued Apr. 22, 1958, to W. E. Phelps; U.S. Pat. No. 129,479, issued July 16, 1872, to J. Johnson; U.S. Pat. No. 2,572,242, issued Oct. 23, 1951, to D. Burchett; U.S. Pat. No. 126,396, issued May 7, 1872, to P. H. Jackson; and U.S. Pat. No. 3,220,367, issued Nov. 30, 1965, to J. L. Stein.

The Cruciani and Buckley systems disclose tensioning members but without standard components.

The Kreuger, Davidson, Adams, et al, Phelps, Burchett, and Stein systems use modular components but without tensioning means integral to the modular components.

The Gross and Ewing systems use modular components with tensioning means external to the components which requires more clearance.

The Jackson and Johnson systems, although using modular components, do not use components of identical shape and channels for the structure.

See also U.S. Pat. No. 187,513, issued Feb. 20, 1877 to E. E. Coley; U.S. Pat. No. 2,869,182 issued Jan. 20, 1959 to W. S. White, Jr.; U.S. Pat. No. 1,420,810, issued June 27, 1922 to G. M. Bean, U.S. Pat. No. 852,202, issued Apr. 30, 1907 to H. M. Russell, Jr.; U.S. Pat. No. 3,274,742, issued Sept. 27, 1966 to W. B. Paul, Jr., et al; U.S. Pat. No. 3,091,002, issued May 29, 1963 to L. E. Nicholson; U.S. Pat. No. 887,284, issued May 12, 1908 to M. J. Stoffer; U.S. Pat. No. 2,499,478, issued Mar. 7, 1950 to E. J. Feser; which may be considered of general or incidental interest to one or more aspects of the present invention.

SUMMARY OF THE INVENTION

The present invention uses a very simple but highly effective design to construct support structures from specially designed modular components of a few types. The present invention, while utilizing modular components, uses them in combination with tensioning rods inserted within the modular components in predetermined patterns to limit the number of types of components necessary. The present invention contemplates the use of a series of blocks (preferrably three or more) held together by a series of internal, long, angularly disposed tension rods or bolts, the combination of which can be used as a truss or weight/load bearing member. There are two basic embodiments, one for forming a curved support member and the other for forming a straight support member or the two embodiments combined together to form a combination support member.

The components can be beveled further on edges in order to permit construction of spiral structures.

In addition, alignment adjustment is possible through varying the tension in the bolts that connect the component modules together.

Moreover the different types may be combined through the use of additional standard channels in the components.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein:

FIG. 1 is a side elevated view of the angle-type block component of the first preferred embodiment of the apparatus of the present invention; while

FIG. 3 is a side elevated view of the straight-type block component of a second preferred embodiment of the apparatus of the present invention; while

FIG. 5 is a side partial view of a set of angle-type members connected with tension rods in an arch as the first preferred embodiment of the apparatus of the present invention; while

FIG. 7 is a side view of an arch using the angle-type members for the upper part of the arch and the straight-type members for the lower part of the preferred embodiments of the apparatus of the present invention; while

DETAILED DESCRIPTION OF THE PREFERRED EMBODIMENTS

Introduction

The support construction system of the preferred embodiments of the present invention may be used to construct support structures of any type of arch or straight support construction wherein it is desirable that the support structure be constructed in a modular manner with variable tensioning between the members. A particularly important area of application of the present invention is arch construction wherein the modular components are used to support a covering structure, and, therefore, the preferred embodiments will be described with respect to such applications. However, it should be realized that the present invention could be applied to, for example, any application where it is desired to construct support structures, or arches covered or uncovered, of varying shapes using a small number of standard component types both for utilitarian purposes or indeed as a construction or building block type toy.

In the preferred embodiments of the present invention, the construction of the structure is accomplished through the use of two types of construction members, a straight structure member and an angled structure member, in combination with tension rods composed of bolts and nuts to hold the members together. The construction is accomplished in such a manner that the two types of components can be combined to give the proper arching and distance and are held together with the tensioning members.

Structure and its Method of Use

The present invention contemplates the use of a series of blocks (preferrably three or more) held together by a series of internal, long, angularly disposed rods or bolts, the combination of which can be used as a truss or weight/load bearing member. There are two basic embodiments, one for forming a curved support member (note FIGS. 1, 2, & 5) and the other for forming a straight support member (note FIGS. 3, 4, and 6), both embodiments being similar and having symetrical sides with smooth faces.

Figure 1:
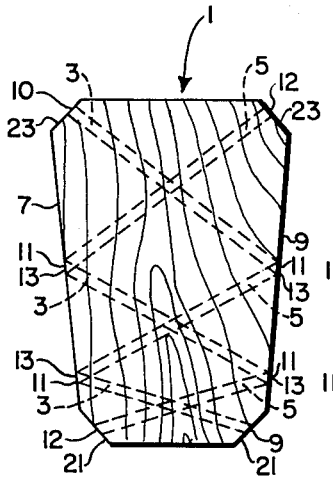
Figure 2:
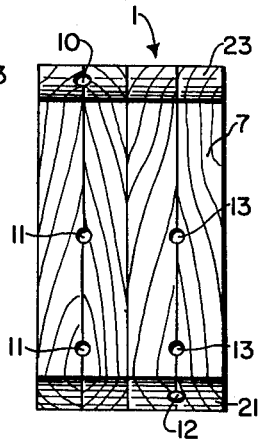
FIG. 2 is a back or front elevated view of the symetrical angle-type block component of FIG. 1.

Referring particularly to FIGS. 1 and 2, there is shown an angle component or block 1 with six cylindrical bolt channels 3 and 5 (three each) passing up from the back 7 to the front 9 and down from the front side 9 to the back side 7, respectively (going from the perspective of right to left in the drawings). The position of channels 3 and 5 are in a direct relationship with the angle of sides 7 and 9, respectively, from the vertical in order to successfully interface with the channels in the next adjacent block (note FIG. 5). The angle of channels 3 and 5 thus is such as to permit continuous channels as members 1 are placed against each other with their front and back facing sides together to give a continuous channel for bolts 19 to pass through preferrably three of such blocks which are held in place by nuts 17 to hold the members in tension. The angle of back and front 7 and 9, respectively, to the vertical directly dictates the number of members 1 necessary to form any particular angle for the support structure. Channels 3 and 5 terminate in bevel holes 10 and side holes 11 for channel 3, and bevel holes 12 and side holes 13 for channel 5. It is noted that FIG. 2 shows the terminations for back 7, better showing one set of the termination holes 10 – 13. Bevels 21 and 23 angled to permit bolts 19 and nuts 17 to be exposed for termination and mounting. As best illustrated in FIG. 2, the internal bolt channels 3,5 are offset from each other in opposite, side, parallel planes so that one channel does not pass through or intercommunicate with another channel.

Figure 5:
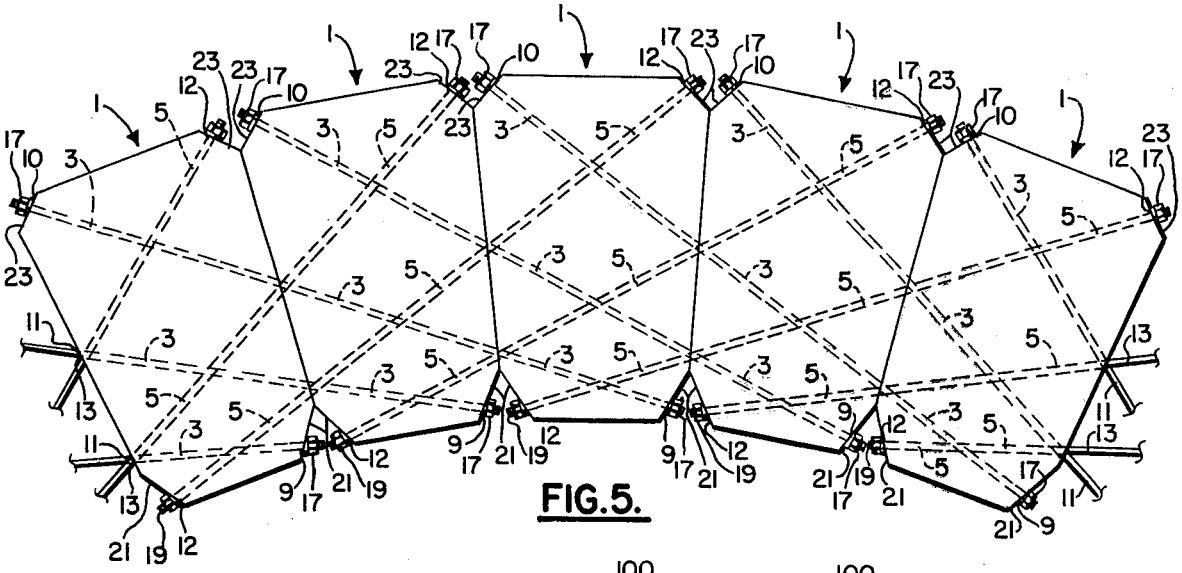
Figure 6:
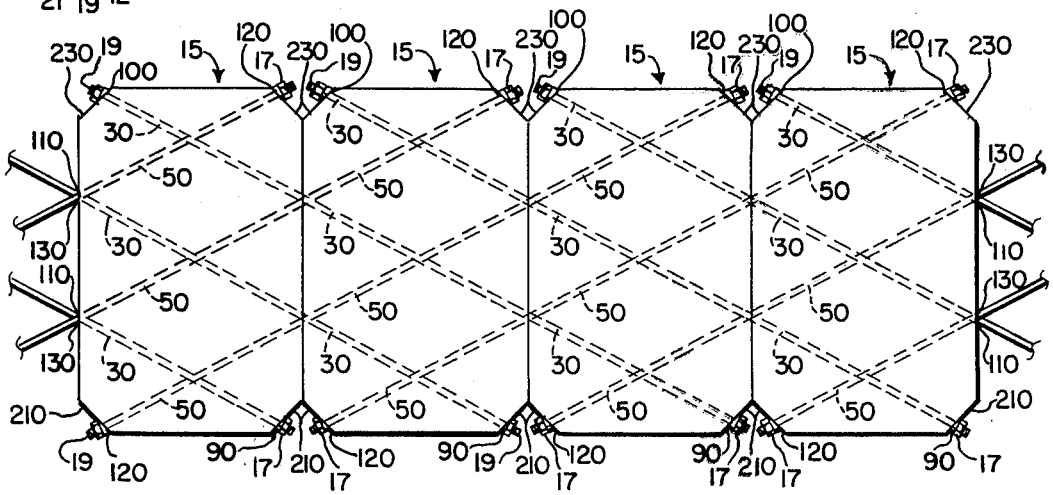
FIG. 6 is a side partial view of a set of straight-type members connected by tension rods as the second preferred embodiment of the apparatus of the present invention.

As best shown in FIG. 5, bolts 19 are inserted in channels 3 and 5 connecting and binding together the adjacent angle blocks 1 which are then placed in tension by the application of bolt nuts 17. It is noted that each bolt 19 passes through three adjacent blocks 1, and that the number of "up" channels and the number of "down" channels equal three, and the relationship of channel number per direction per block and number of blocks per bolt should always be equal. Due to the presence of the bevel sections 21 and 23, the threaded bolt endings and nuts generally lie under the continuous upper and lower main surfaces of the blocks 1, thereby not adding to the exterior bulk of the combined structure.

It should be noted that the drawings are generalized illustrations and should not be taken completely literally as to the most preferred embodiments, although the details of the blocks illustrated will work satisfactorily. In particular the bottom beveled surface 21 of a first block should be parallel to the top beveled surface 23 of the third block, and the beveled surfaces 21, 23 should be normal to the straight channels 3, 5 terminating in those surfaces; thereby the beveled surfaces will mate in flat engagement with the undersides of the nuts 17 (or washers placed there beneath) for best fit. Also, most preferably, the beveled surfaces should be made deeper than that illustrated so that all the nuts and bolts will be below upper and lower main surfaces of the blocks, presenting a generally smooth surface.

Figure 3:
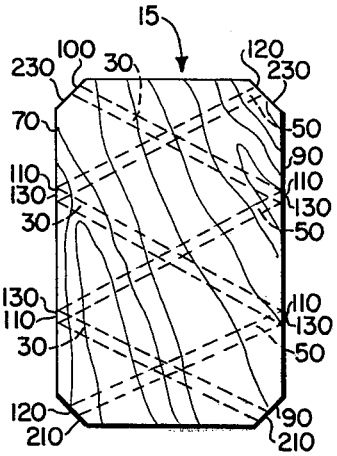
Figure 4:
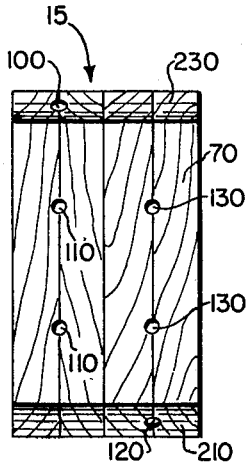
FIG. 4 is a back or front elevated view of the symetrical straight-type block component of FIG. 3.

Similarly, as illustrated in FIGS. 3 & 4, straight section block 15 has channels 30 and 50 running down from back 70 to front 90 and up from front 90 to back 70, respectively. For straight member sections 15, however, back side 70 and front side 90 are parallel. Upper and lower corners 230 and 210 are beveled to permit room for bolts 19 and nuts 17. Holes 100, 110, 120, and 130 receive bolts 19 which pass therethrough to bind members 15 together which are then placed under tension by nuts 17.

Figure 8:
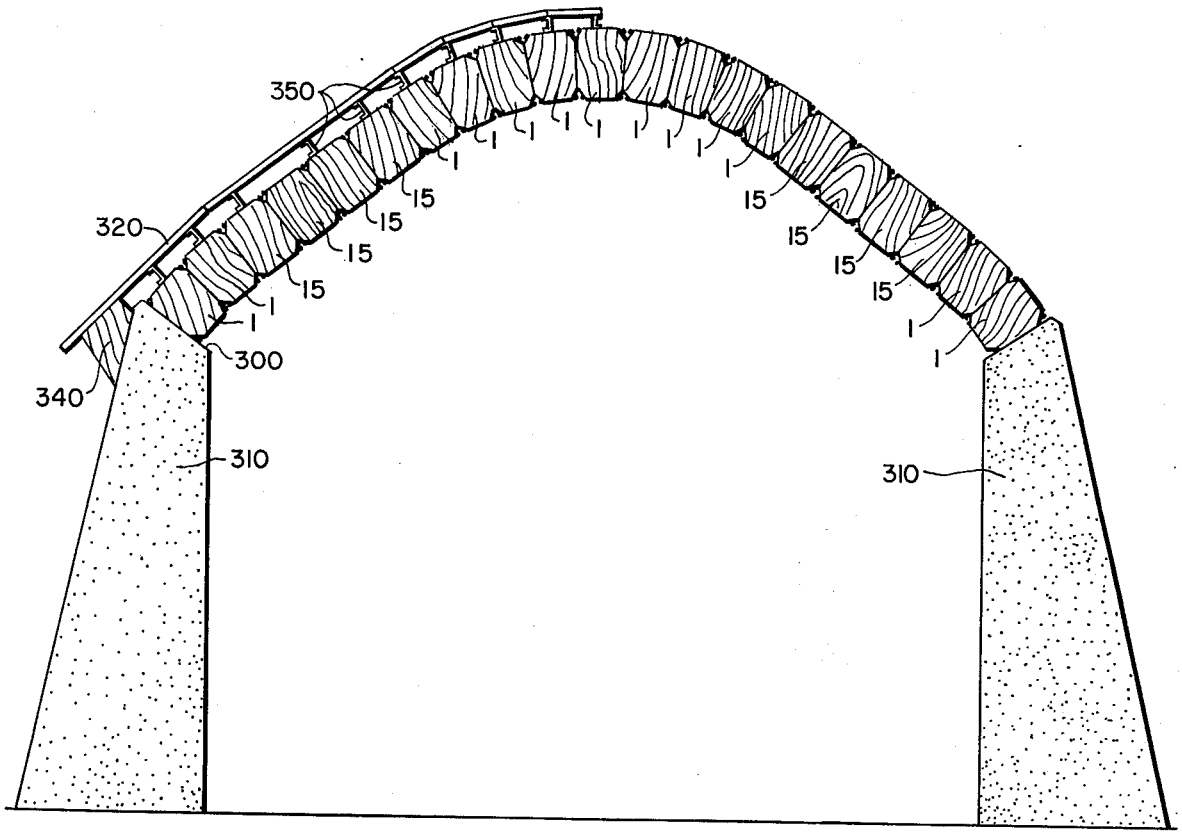
FIG. 8 is a side view of an arch using a combination of straight and curved members of the preferred embodiments of the apparatus of the present invention.

Additional termination holes and appropriately angled channels (not illustrated) can be provided in members 1 and 15 offset from one vertical plane to another from the "standard" channels 3, 5 to form a continuous channel between one or more members 15 and one or members 1 for bolts 19 to form a combined straight and curved structure as illustrated in FIG. 8. The appropriate angle for each channel will vary from block position to block position, depending on the mix of straight and curved block elements, but they can be easily calculated depending on the specifics of each combination. If desired, the blocks could be pre-assembled in a temporary holding jig at the manufacturing site and the channel holes appropriately drilled, and the drilled blocks then reassembled at the job site in their proper position. However, the relationship between the channel angles and the relative angles of the facing sides of the block and the thickness of the blocks and the overall angle or length of the composite structure can be relatively easily determined by mathematical and geometrical calculations for any particular relationship.

When members 1 and 15 are placed together, the amount that member 1 will extend below member 15 back or front is equal to: $T(\sec^2\phi - 1)$ where $T$ is the length of side 15 and $\phi$ is the angle of the back or front of member 1 with respect to the vertical.

Figure 7:
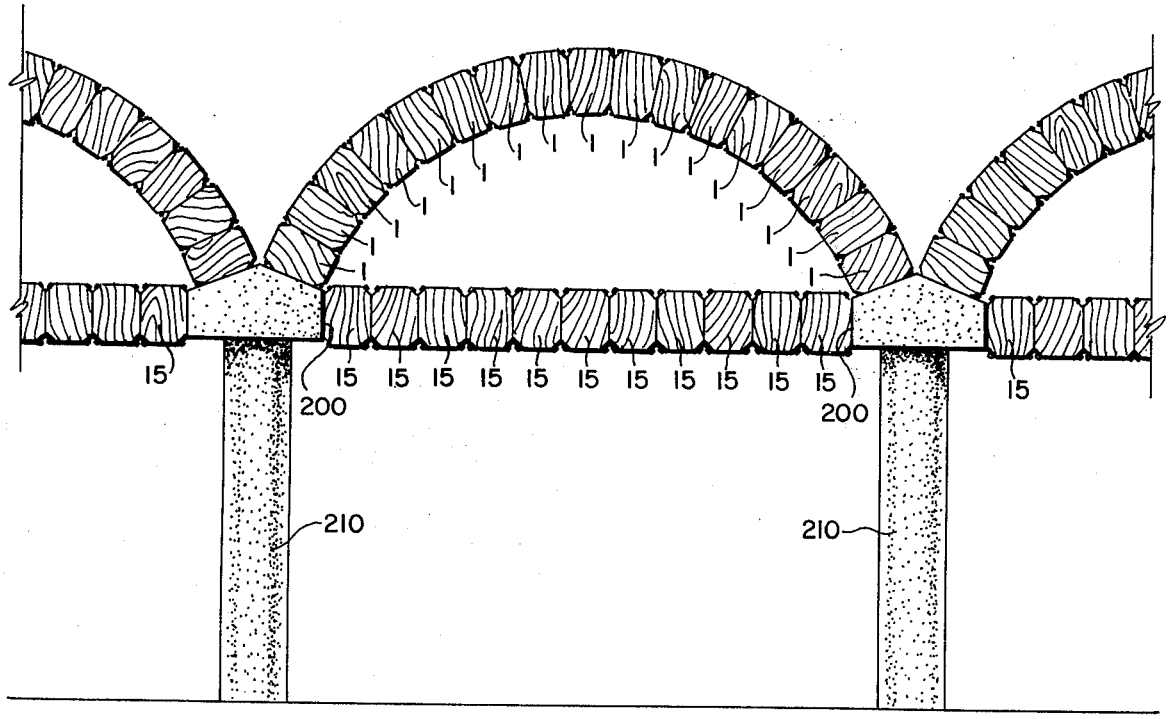

In using these components, as shown in FIGS. 1 and 2, a curved member 1 as shown in FIGS. 7 and 8 is mounted on bases 200 or 300, respectively. It is noted that the applications shown in FIGS. 7 & 8 are just for generalized, illustrative purposes, and the block sections can be used for many construction or construction type toy applications, e.g. for building bridges as well as building components. The bases 200 and 300 are mounted on columns 210 and 310 respectively. Additional angle and straight members 1 and 15 are then connected together through the use of bolt 19 and tensioning nuts 17 to bind the members 1 and 15 together. As shown in FIG. 7, angle members 1 form an arch and straight members 15 form a straight section as required or desired for the support structure. As shown in FIG. 8, angle members 1 and straight members 15 combine to form a support structure for surface 320. Surface 320 is mounted on support struts 330. Support 340 supports the edge of surface 320 against column 310. In fastening a set of blocks to its terminal support structures (e.g. bases 200, 300) the projecting rods 19 from the last of each of the end blocks (note the left and right end portions of FIGS. 5 & 6) could be used, or, alternatively, the projecting ends thereof cut off and a separate fastening structure used.

Although the system described in detail supra has been found to be most satisfactory and preferred, many variations in structure and method are, of course, possible. For example, the system can also be adapted for spiral staircases by appropriately angling the other sides between the back and sides 7, 9. Also, the system can use several angular sections of different types and non-symetrical sides to form various angles and shapes. Moreover, the blocks may be made out of wood, prestressed concrete, or other material.

Additionally, rather than the edges being fully beveled at the corners 21, 23, intermediate, circular depressions or "valleys" could be provided in the top and bottom surfaces restricted to the area needed for access to bolt channels and manipulation of the nuts. Of course, tension fasteners other than nuts could be used with the bolts. Moreover, rather than just two sets of three channels as illustrated, more sets could be provided, particularly if the width of the blocks were greater, to enhance the amount and distribution of the tensioning force. Also rather than each bolt passing through three blocks with three channels in each direction being provided, a two block embodiment with two appropriately angled channels, or four block embodiment with four appropriately angled channels, etc., could be used; although the three block embodiment is most preferred.

The above are, of course, merely exemplary of the possible changes or variations. Because many varying and different embodiments may be made within the scope of the inventive concept herein taught and because many modifications may be made in the embodiments herein detailed in accordance with the descriptive requirements of the law, it is understood that the details herein are to be interpreted as illustrative and not in a limiting sense.

What is claimed as invention is:

1. A modular, multi-block construction for placement between anchor members comprising:

a series of at least three blocks, the end blocks of said series of blocks being mounted on the anchor members, each internal block of said series of blocks having opposite facing sides in face-to-face engagement with the facing sides of the adjacent blocks, and opposite exterior sides, and a top and an opposite bottom, said facing sides, said top and said bottom, and said exterior sides being joined together forming the outsides of the block, and at least two sets of at least three diagonally disposed channels each therein, each set being offset from the other and extending in diagonally opposite directions from the other through at least substantially the full width between said opposite facing sides of each block, each angularly disposed channel being in continous, line alignment with a mating channel in at least two adjacent blocks, each set of aligned, mating channels extending at least substantially through the full height between the top of one block and the bottom of another block at least one block removed from said one block; and

2. The construction of claim 1 wherein said fastening means comprises a series of double-ended, threaded, elongated bolts with the threaded tips thereof extending out of said series of blocks with nut means threaded thereon compressively bearing against the exterior surfaces of said blocks adjacent said bolts.

3. The construction of claim 1 wherein the cross-sections of at least some of said blocks in the plane perpendicular to the top and bottom of each such block are at least generally trapezoidal in shape, such blocks forming a curved section.

4. The construction of claim 1 wherein the cross-sections of at least some of said blocks in the plane perpendicular to the top and bottom of each such block are at least generally rectangular in shape, such blocks forming a straight section.

5. The construction of claim 1 wherein the cross-sections of at least some of said blocks in the plane midway between and parallel to the top and bottom of each such block are at least generally rectangular in shape.

6. The construction of claim 5 wherein the said cross-sections are square.

7. The construction of claim 1 wherein said series of blocks include blocks having different configurations, wherein the cross-sections of at least some of said blocks in the plane perpendicular to the top and bottom of the blocks are at least generally trapezoidal in shape and others are at least generally rectangular in shape, such blocks forming both straight and curved sections.

8. The construction of claim 1 wherein each internal block has four beveled sections located at the junctions between said top and bottom and each of said opposite facing sides, at least a separate one of said channels terminating in separate ones of said beveled sections.

9. A block for a modular, multi-block construction comprising:

a piece of substantially solid, non-compressible material and opposite exterior sides, and a top and an opposite bottom, said facing sides, said top and said bottom, and said exterior sides being joined together forming the outsides of the block; and at least two sets of at least three angularly disposed channels each therein, each set being offset from the other and in diagonally opposite directions from the other through at least substantially the full width between said opposite facing sides with the three channels of each set lying in the same plane, the first one of which extends from the junction between one of said facing sides and the bottom or the top to the other of said facing sides, the second one of which extends from said one of said facing sides to said other facing side both at locations substantially removed from the junctions of said facing sides with said top and bottom, and the third of which extends from said one of said facing sides to the junction of each other of said facing sides and the top or bottom, respectively, the entrance and exit locations of each channel being progressively higher or lower, respectively, from one channel to the other.

10. The block of claim 9 wherein the cross-section of said piece of material in the plane perpendicular to the top and bottom thereof is at least generally trapezoidal in shape.

11. The block of claim 9 wherein the cross-section of said piece of material in the plane perpendicular to said top and bottom is at least generally rectangular in shape.

12. The block of claim 9 wherein the cross-section of said piece of material in the plane mid-way between and parallel to the top and bottom is at least generally rectangular in shape.

13. The block of claim 9 wherein there is further included on said piece of material four beveled sections located at the junctions between said top and bottom and each of said opposite facing sides, at least a separate one of said channels terminating in separate ones of said beveled sections.

* * * * *